US006171143B1

(12) United States Patent
Charles et al.

(10) Patent No.: US 6,171,143 B1
(45) **Date of Patent: *Jan. 9, 2001**

(54) MULTIPLE COAXIAL CABLE CONNECTOR

(75) Inventors: Stuart Alan Rhys Charles, Great Dunmow; Ian Brown, Bangor, both of (GB)

(73) Assignee: Nortel Networks Limited, Montreal (CA)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/065,934

(22) Filed: Apr. 24, 1998

(51) Int. Cl.[7] ..... H01R 9/05
(52) U.S. Cl. ..... 439/579; 439/607
(58) Field of Search ..... 439/579, 607, 439/578, 609, 610

(56) References Cited

U.S. PATENT DOCUMENTS

| | | | | |
|---|---|---|---|---|
| 3,825,874 | * | 7/1974 | Peverill | 438/579 |
| 4,340,265 | | 7/1982 | Ott et al. | 439/579 |
| 4,456,317 | * | 6/1984 | McCleerey | 439/607 |
| 4,619,494 | * | 10/1986 | Noorily et al. | 439/607 |
| 4,687,263 | * | 8/1987 | Cosmos et al. | 438/607 |
| 4,889,500 | | 12/1989 | Lazar et al. | 439/579 |
| 4,981,447 | * | 1/1991 | Ichitsubo | 439/607 |
| 5,184,965 | * | 2/1993 | Myschik et al. | 439/607 |
| 5,480,327 | * | 1/1996 | Zola | 439/607 |
| 5,997,348 | * | 12/1999 | Shepherd | 439/579 |

FOREIGN PATENT DOCUMENTS

| | | |
|---|---|---|
| 42 36 945 | 5/1994 | (DE) . |
| 0 073 600 | 3/1983 | (EP) . |

OTHER PUBLICATIONS

"Shielded Connector Assembly Using Metalized Plastic", IBM Technical Disclosure Bulletin, vol. 30, No. 12, May 1988, pp. 84–85.

* cited by examiner

*Primary Examiner*—Paula Bradley
*Assistant Examiner*—Tho D. Ta
(74) *Attorney, Agent, or Firm*—Lee, Mann, Smith, McWilliams, Sweeney & Ohlson

(57) ABSTRACT

Connectors for connecting multiple coaxial cables are typically complex with many parts and difficult to assemble. The present invention provides an improved multiple coaxial cable connector and a method of using the same. The preferred connector comprises a socket connector adapted to receive a plurality of coaxial cables each terminated in a termination socket and to expose at least a part of each socket when fitted, a connection element, and a casing component adapted to receive the coaxial cables and including at least partial metallisation to a face plate. The connection element bonds each termination socket to the casing component face plate and when connected, to a receiving element for the cable connector. Preferably the socket connector is an SCI connector and the termination sockets are SCI sockets. The connection element preferably includes spring fingers corresponding to each termination socket.

13 Claims, 4 Drawing Sheets

MULTIPLE COAXIAL CABLE CONNECTOR

FIELD OF THE INVENTION

The present invention relates to improvements in or relating to multiple coaxial cable connectors.

PRIOR ART

Typically when coaxial cables are connected to an item of electrical equipment, the signal path from the coaxial connector to the circuit board (PCB) of the equipment is not coaxial. This non-coaxial manner of termination results in a radiated emissions phenomena known as pigtailed radiation in which the non-coaxial parts of the signal path actually radiate part of the signal. The intentional circuit current flowing through this connection produces a volt drop that acts as an excitation voltage between the equipment PCB/frame ground and the coaxial cable braid. This produces an end driven dipole mode of electromagnetic radiation. Additionally, the penetration of the coaxial cable screen into the equipment enclosure allows spurious signal coupling to the screen which also causes the cable screen to radiate unintentional electromagnetic radiation (probe effect).

Where large numbers of coaxial cables are required, for example in telecommunications multiplexers, individual coaxial connector terminations are impractical and D-type or screened controlled impedance (SCI) style connectors would typically be used to enable cost effective mass termination of the coaxial cables. While the effect of pigtailed coaxial radiation or probe effect EMR on one cable may be small and well below Class B emission limits (Euro-Norm EMC Standard EN55022), aggregation from many cables exacerbates this effect and can produce Class B and even Class A failures or poor margins.

One prior art attempt at reducing this problem is to ground the outer coaxial braids of the cables to the PCB/frame ground at their ingress to a connector. In this arrangement a section of each cable is stripped to expose the braid which is then bunched together and grounded by a metal strap (at entry to the connector) and conductive pathway to the PCB/frame ground. This arrangement however does not provide positive grounding on each cable, particularly as the number of cables bunched together increases.

U.S. Pat. No. 4,340,265 discloses a multi-socket coaxial assembly in which an electrically conducting moulded shell is employed which includes an integrally moulded connector plate having apertures into which the outer conductors of coaxial cables are inserted making electrical contact. The connector includes a specially cast shell and integrally formed connector panel with a plurality of apertures adapted to receive both coaxial and power cables. This connector arrangement is expensive to produce and time consuming to assemble and is not suitable for large numbers of coaxial cables for which connection is required in a relatively small space.

U.S. Pat. No. 4,889,500 discloses a multiple coaxial cable leads plug which includes a honeycomb grounding block to engage the outer conductor of each coaxial terminal. This many part connector is both expensive and complex to produce and to assemble during installation of the cables.

OBJECT OF THE INVENTION

It is an object of the present invention to provide an improved cable connector for multiple coaxial cables.

It is a further object of the present invention to reduce electromagnetic radiation emanating from multiple coaxial cable connectors.

SUMMARY OF THE INVENTION

In a first aspect of the present invention there is provided a cable connector comprising:

a linear socket connector for terminating a plurality of coaxial cables in respective sockets;

a casing component for housing said socket connector;

and a connection element;

wherein said connection element is arranged to contact each coaxial cable to electrically connect each said cable to an outer surface of the casing component whereby to reduce electromagnetic radiation emissions.

In a second aspect of the invention there is provided a cable connector comprising:

a socket connector for receiving a plurality of coaxial cable termination sockets;

a connection element;

a casing component adapted to receive a plurality of coaxial cables;

wherein said socket connector exposes at least a part of each termination socket when fitted, and wherein said connection element is arranged to electrically connect each said exposed part to an outer surface of the casing component.

Screened controlled impedance sockets refers to coaxial cable connectors as described in U.S. Pat. No. 5,184,965 (Myschik) and the corresponding socket connectors which are both well known in the art.

Preferably said socket connector is an SCI connector and said termination sockets are SCI sockets. Preferably said SCI connector comprises a longitudinal recess or cut-away which exposes the outer conductors of said SCI sockets when fitted.

Preferably said SCI connector comprises two longitudinal recesses on opposite sides of said SCI connector, each of which expose the outer conductors of said SCI sockets when fitted. Preferably said recesses are located at different sectional heights on said SCI connector.

Preferably said connection element comprises a plurality of spring fingers each adapted to contact a termination socket. Preferably the spring fingers are comprised of berrillium copper alloy. Alternatively, the connection element may be an electrically conducting strip for example a conductively loaded elastomer strip. As a further alternative the connection element may be integrally formed within the casing component.

Preferably, where said SCI connector comprises two longitudinal recesses, said cable connector comprises two connection elements located to connect each said SCI socket from two sides to said casing component.

Preferably said casing component is comprised of two parts. Preferably said casing components are comprised of metal, alternatively the casing components may be comprised of metallised plastic. As a further alternative, the casing components may comprise a metallised strip secured to a plastic casing, said strip extending from connection with the connection element to the face plate of said casing components. As a still further alternative, the connection element may extend to the face plate.

Preferably, said cable connector comprises a plurality of coaxial cables each terminated with a termination socket.

In a further inventive aspect the present invention provides a method of connecting a plurality of coaxial cables using a cable connector comprising:

a socket connector for receiving a plurality of coaxial cable termination sockets;

a connection element;

a casing component adapted to receive a plurality of coaxial cables;

wherein said socket connector is adapted to expose at least a part of each termination socket when fitted, and wherein said connection element is arranged to electrically connect each said exposed termination socket to an outer surface of the casing component, the method comprising the steps of:

fitting a plurality of coaxial cables each terminated in a termination socket into said socket connector;

securing said casing component to said socket connector such that said connecting element bonds each termination socket to said outer surface;

securing said cable connector to a receiving element.

BRIEF DESCRIPTION OF THE DRAWINGS

In order to show how the invention may be carried into effect, embodiments of the invention are now described below by way of example only and with reference to the accompanying figures in which.

DETAILED DESCRIPTION OF THE INVENTION

Figure 1:
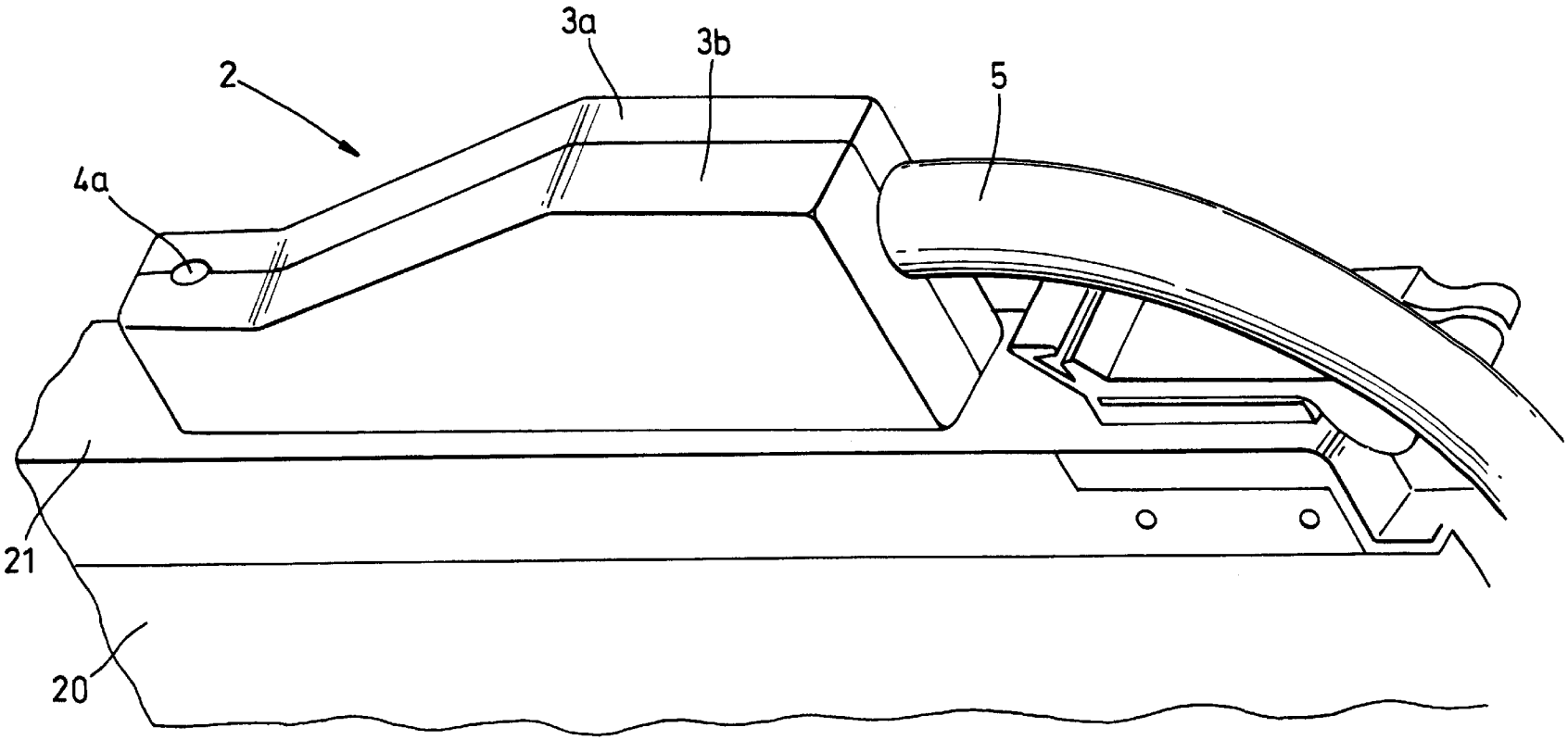
FIG. 1 shows the connector connected to the face plate of an item of electrical equipment.

FIG. 1 shows a preferred connector 2 of the invention connected to the face plate assembly 21 of a printed circuit board 20 forming part of an electronic system, for example a telecommunications multiplexer unit. The connector 2 comprises two casing components 3*a* and 3*b* which are adapted to receive a cable loom 5 containing a number of coaxial cables. The connector 2 is in positive electrical contact with the PCB face plate 21 using one or more screws 4*a* and 4*b*.

Figure 2:
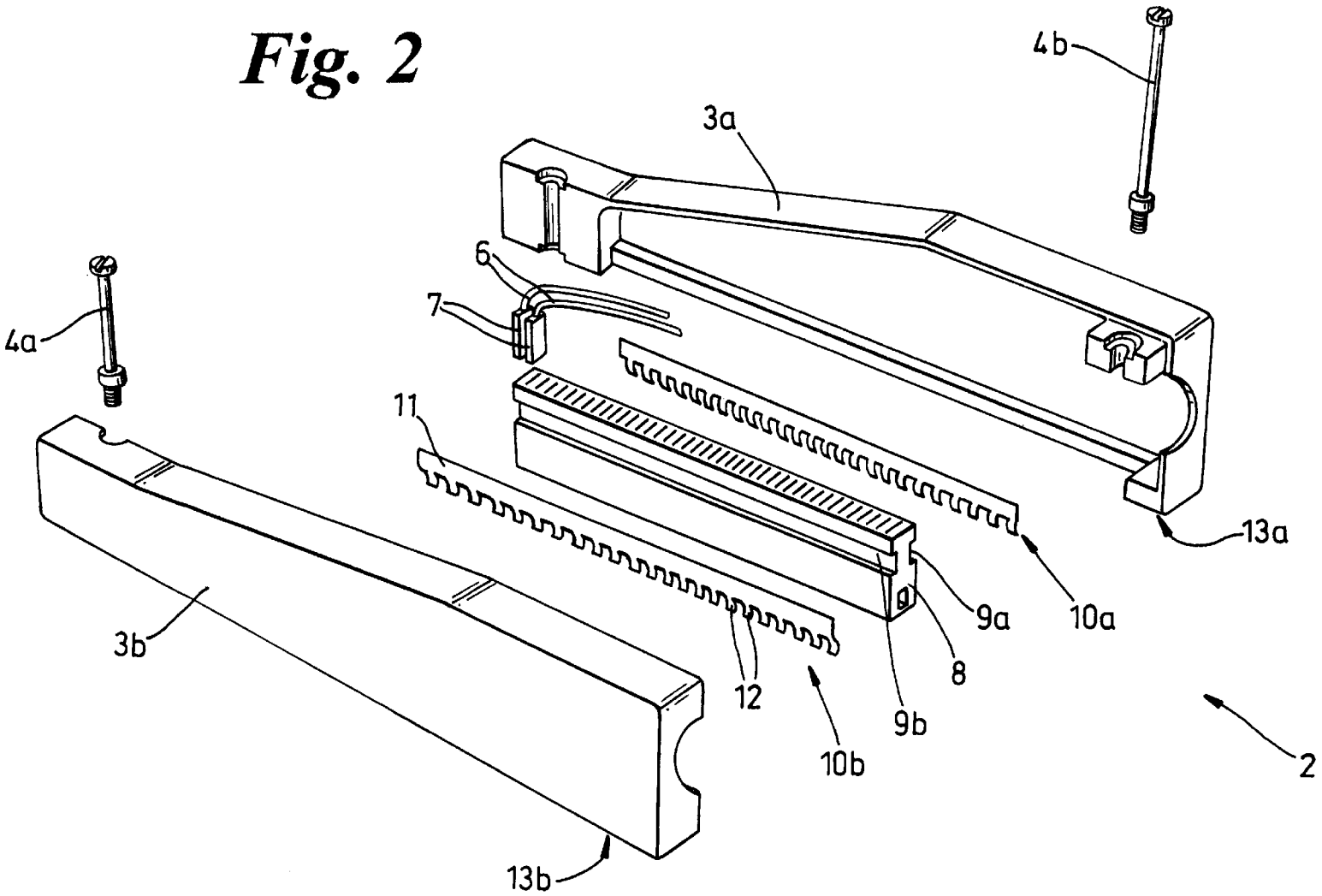
FIG. 2 shows an exploded perspective view of the components of a preferred connector.

Referring to FIG. 2, the connector 2 further comprises a socket connector 8, and two connecting elements 10*a* and 10*b*. The socket connector 8 is adapted to receive coaxial cable termination sockets 7. The socket connector 8 includes two longitudinal recesses 9*a* and 9*b* which are adapted to expose part of the outer conducting casing of each termination socket 7. Preferably the longitudinal recesses 9*a* and 9*b* are located at different sectional heights of the socket connector 8 to improve the mechanical rigidity of the socket connector 8.

Preferably the socket connector 8 and the termination sockets 7 are of the SCI type.

The connecting elements 10*a* and 10*b* each comprise a metallic strip 11 from which are formed a plurality of metallic fingers 12 which contact respective termination sockets 7. The connecting elements 10*a* and 10*b* are located between the socket connector 8 and the casing components 3*a* and 3*b* respectively such that each cable termination socket 7 when fitted into the socket connector 8 is connected via a respective spring finger 12 and metal strip 11 to the casing components 3*a* and 3*b*.

But it would be understood by those skilled in the art that an alternative to exposing the termination sockets would be to expose a portion of the outer case of the coaxial cable which would be connected to the casing components 3*a* and 3*b* by the spring fingers 12 and metal strip 11.

The casing components 3*a* and 3*b* are preferably comprised of metal although they may be metallised plastic for example provided there is a conducting path from the connecting elements metal strip 11 along the casing component 3*a* or 3*b* to the face plates 13*a* and 13*b* of the casing components 3*a* and 3*b*. The face plates 13*a* and 13*b* are metallised and when the cable connector 2 is connected to an item of electrical equipment 20 for example, the metallised face plates 13*a* and 13*b* are secured in electrical contact with the face plate assembly 21 of the electrical equipment 20 by securing screws 4*a* and 4*b*. This ensures that each coaxial cable 6 has its outer conductor electrically connected to the face plate 21 of the equipment 20 to which the cable connector 2 is secured.

The connecting elements 10*a* and 10*b* are preferably comprised of a springy material such as berrillium copper alloy for example, to ensure positive contact between the casing components 3*a* and 3*b* and each cable termination socket 7. The spring fingers also allow for some movement of the termination socket 7 when the cable connector 2 is fitted to the piece of electrical equipment 20. Alternatively, the connecting elements 10*a* and 10*b* may be comprised of an electrically conducting strip adapted to connect each termination socket 7 to the casing components 3*a* and 3*b*. This electrically conducting strip may be comprised of a conductively loaded elastomer strip for example silver or copper. As a still further alternative, the connecting elements 10*a* and 10*b* may be formed integrally with the casing components 3*a* and 3*b* respectively. Various other methods of connecting the termination socket 7 to the casing components face plates 13*a* and 13*b* could also be used, for example a connection element 10*a* or 10*b* which extends to the face plates 13*a* and 13*b*.

As a further alternative, only one connecting element 10*a* may be used in the cable connector 2, the socket connector 8 requiring only a single longitudinal recess 9*a* and the cable connector 2 requiring only a single metallised bonding path on casing component 3*a* between the connecting element 10*a* and the face plate 13*a*.

Figure 3:
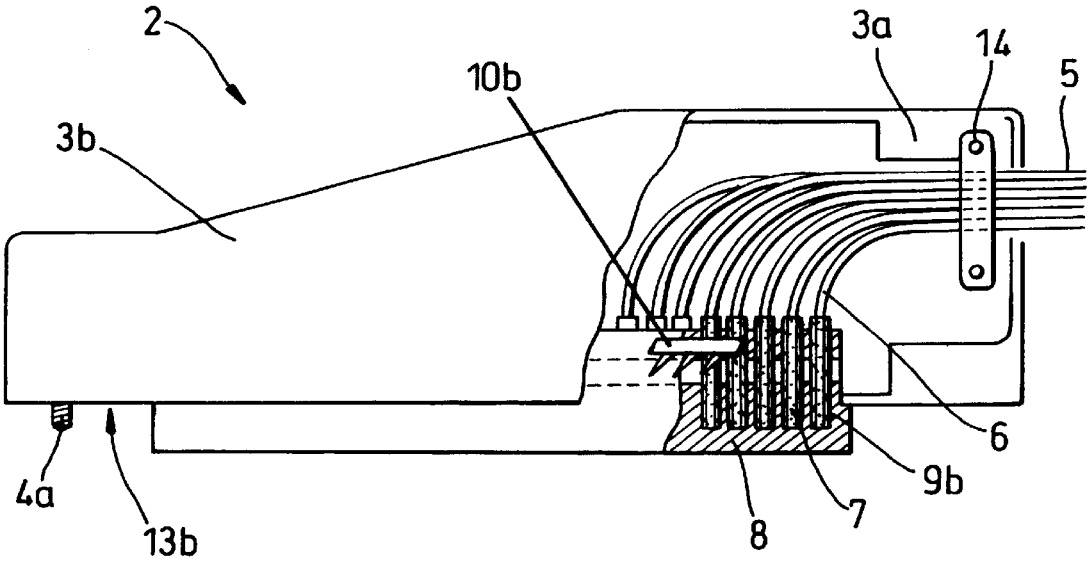
FIG. 3 shows a section cut-away of the connector with coaxial cables fitted.
Figure 4:
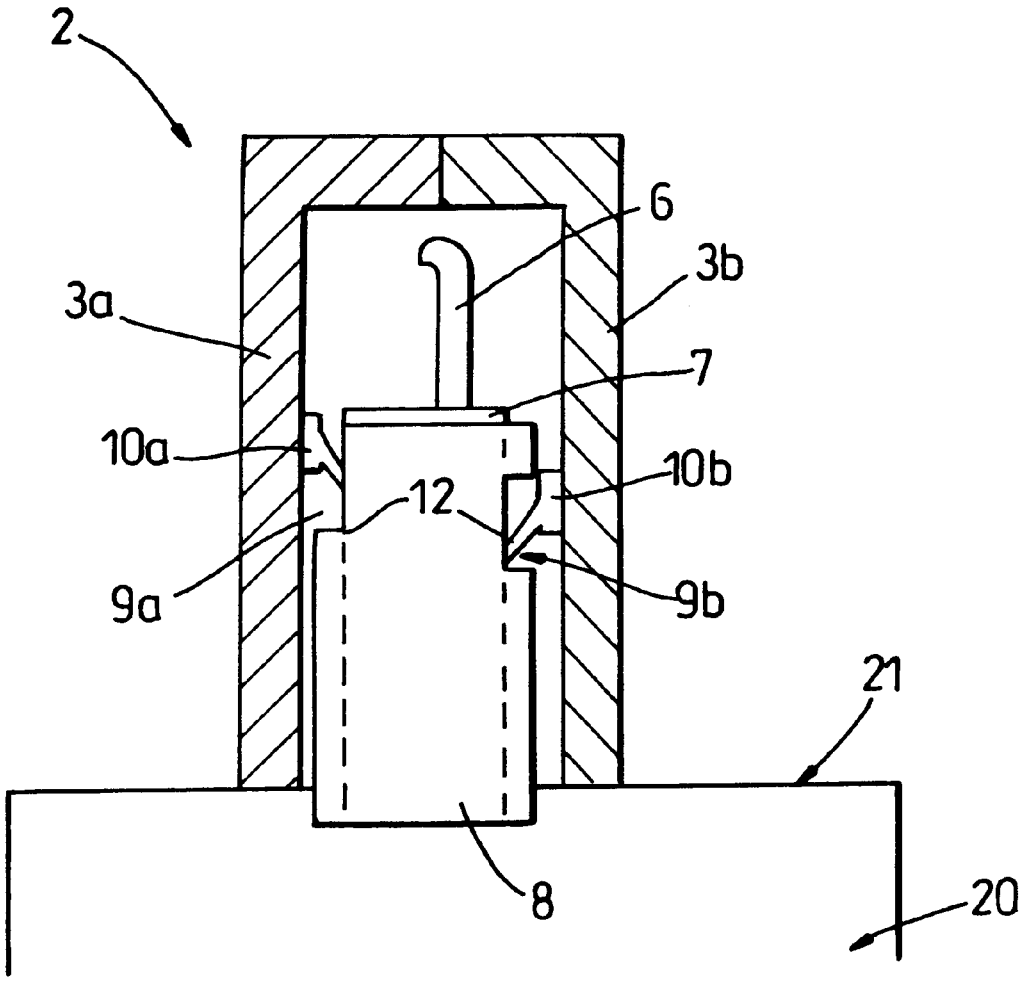
FIG. 4 shows a cross section of the coaxial connector with coaxial cables fitted.

Referring to FIG. 3, the cable connector 2 is shown assembled with a cable loom 5 comprising a plurality of coaxial cables 6 entering the cable connector 2 and secured at the point of entry by a fixing element 14. Each coaxial cable 6 is terminated in an SCI socket 7 in which the outer square section conductor of the socket 7 is connected to the outer coaxial cable conductor, the termination socket 7 terminating in two non-coaxial sockets (not shown) corresponding to the inner and outer coaxial cable conductors. The SCI socket 7 maintains the coaxial electro-magnetic radiation suppression effect up to the non-coaxial sockets. The termination sockets 7 are fitted into the socket connector 8 which mates with a corresponding connector when the cable connector 2 is engaged in the face plate 21 of a piece of electrical equipment 20.

The longitudinal recess 9*b* in the socket connector 8 exposes the metallic outer conductor of each termination socket 7 such that it is connected to a metallic part of the casing component 3*b* by the connecting element 10*b* (not shown). This provides a conduction path between each termination socket 7 and the face plate 13*b* of the outer casing 3*b*, such that the outer conductor of each coaxial cable 6 is bonded to the face plate 21 which mates with the cable connector's face plate 13*b*. Similarly, a recess 9*a* on the other side of the socket connector 8 allows a further connecting element 10*a* to connect individual termination sockets 7 to the other casing component 3*a* such that each termination socket is bonded to the face plate 13*a* of that casing component 3*a*.

The cable connector 2 of the invention provides improved bonding between multiple coaxial cables 6 and the ground 21 of equipment 20 to which the cable connector 2 is connected. The assembly 2 is easier and cheaper to manufacture than prior art arrangements and is also easier and faster to install saving on labour costs.

The connecting elements 10*a* and 10*b* are preferably secured to either the casing components 3*a* or 3*b*, or the socket connector 8 before installation of the coaxial cable 6. The metallic fingers 12 of the connecting elements 10*a* and 10*b* are pitched into the socket conductor recesses 9*a* and 9*b* to ensure intimate contact with the termination socket 7. The number of fingers 12 on each connection element 10*a* and 10*b* correspond to the number of termination sockets 7 to be fitted to the socket connector 8.

The casing components 3*a* and 3*b* are preferably secured together by screws (not shown) before and after assembly.

In use, coaxial cables 6 with termination sockets 7 are fitted into a socket connector 8. The socket connector 8 is then secured between two casing components 3*a* and 3*b* adapted to receive it and to connect the individual termination sockets 7 to each casing component 3*a* and 3*b* by internal connecting elements 10*a* and 10*b*. The casing components 3*a* and 3*b* are secured together to form the cable connector 2 which is then connected to the face plate 21 of an item of electrical equipment 20 using securing screws 4*a* and 4*b* to ensure positive electrical contact between the respective face plates 13*a* and 13*b* and 21.

The foregoing describes the invention including a preferred form thereof. Alterations and modifications as would be obvious to some one skilled in the art are intended to be incorporated within the scope hereof.

What is claimed is:

1. A coaxial cable connector comprising:

A longitudinally extending socket connector receiving a plurality of coaxial cable termination sockets, said socket connector comprising a longitudinally extended recess arranged to expose an outer conductor of each said socket when fitted;

an electrically conductive casing component housing said socket connector;

and a connecting element arranged to electrically connect each said exposed outer conductor to a face plate of the casing component.

2. The cable connector of claim 1 further comprising a plurality of coaxial cables each terminated in said termination socket.

3. The coaxial cable connector of claim 1, wherein said connecting element comprises a plurality of spring fingers.

4. The cable connector of claim 1 wherein the casing component comprises a metallized portion extending, in use between said face plate and said connecting element.

5. The cable connector of claim 4 wherein the connecting element is formed integrally with said metallized portion of said casing component.

6. The cable connector of claim 1, wherein said socket connector comprises 2 longitudinally extending recesses located on opposite sides of said socket connector, each of which exposes the outer conductor of each said socket when fitted.

7. The cable connector of claim 6, wherein said recesses are located at different transverse heights on said socket connector.

8. A method of connecting a plurality of coaxial cables using a coaxial cable connector having a longitudinally extending socket connector, said socket connector receiving a plurality of coaxial cable termination sockets in a transverse direction and exposing at least a part of each termination socket when fitted, wherein each of the exposed termination sockets is electrically connected to a face plate of an electrically conductive casing component by a connecting element, the method comprising the steps of:

receiving at the socket connector the plurality of coaxial cable;

fitting the plurality of coaxial cables, each terminated in a termination socket, into the socket connector;

securing the casing component to the socket connector such that the connecting element bonds each termination socket to said face plate;

and securing said cable connector to a receiving element.

9. A coaxial cable connector comprising:

a longitudinally extending socket connector terminating a plurality of coaxial cable in respective termination sockets, and receiving said sockets in a transverse direction, said socket connector exposing an outer conductor of each termination socket;

an electrically conductive casing component housing said socket connector; and a connecting element arranged to electrically the outer conductor of each of the termination sockets to an outer surface of the casing component to reduce electromagnetic radiation emissions.

10. The coaxial cable connector of claim 9, wherein said connecting element comprises a plurality of spring fingers.

11. The coaxial cable connector of 9, wherein said socket connector comprises a longitudinal recess which exposes the outer conductors of said termination socket.

12. The coaxial cable connector of claim 9, wherein said socket connector comprises two longitudinally extending recesses located on opposite sides of said socket connector, each said recess exposing an outer conductor of each said sockets.

13. The coaxial cable connector of claim 12, wherein said recesses are located at different transverse heights on said socket connector.

* * * * *